United States Patent [19]

Yamakawa et al.

[11] Patent Number: 5,019,867

[45] Date of Patent: May 28, 1991

[54] IMAGE FORMING APPARATUS HAVING A REMOVABLE PROCESSING UNIT

[75] Inventors: Takeshi Yamakawa, Fujisawa; Misao Tanzawa, Kawasaki, both of Japan

[73] Assignee: Ricoh Company, Ltd., Tokyo, Japan

[21] Appl. No.: 398,395

[22] Filed: Aug. 25, 1989

[30] Foreign Application Priority Data

Sep. 6, 1988 [JP] Japan ..... 63-223245

[51] Int. Cl.[5] ..... G03G 15/06

[52] U.S. Cl. ..... 355/245

[58] Field of Search ..... 355/245, 250, 251, 259, 355/261, 326, 327, 328; 118/647, 651, 661

[56] References Cited

U.S. PATENT DOCUMENTS 4,841,330 6/1989 Owada et al. ..... 355/245
4,851,873 7/1989 Sakao et al. ..... 355/245
4,860,049 8/1989 Toshimitsu et al. ..... 355/245 X
4,894,684 1/1990 Nakajima et al. ..... 355/326 X

*Primary Examiner*—A. T. Grimley
*Assistant Examiner*—Sandra L. Hoffman
*Attorney, Agent, or Firm*—Oblon, Spivak, McClelland, Maier & Neustadt

[57] ABSTRACT

An electrophotographic copier or similar image forming apparatus having a photoconductive drum and a developing unit having a developing roller which is pressed against the drum. The developing unit is removably mounted on a body of the apparatus and arranged such that reaction forces exerted in the vertical direction by the copier body on the developing unit are directed upward at all times. When the pressing contact of the developing roller with the drum is cancelled, the developing unit is held in a retracted position where it is spaced apart from the drum.

9 Claims, 15 Drawing Sheets

($\mu_1$=0.1)

IMAGE FORMING APPARATUS HAVING A REMOVABLE PROCESSING UNIT

BACKGROUND OF THE INVENTION

The present invention relates to an image forming apparatus having body, a photoconductive drum or similar image carrier for forming an electrostatic latent image thereon, a developing unit or similar processing unit supported by the apparatus body to be movable toward and away from the image carrier and having a rotary body pressed against the surface of the image carrier either directly or through other members and a support for supporting it rotatably, and a biasing arrangement means for biasing the processing unit in a direction for pressing the rotary body of the processing unit against the image carrier.

An electrophotographic copier, printer, facsimile machine or similar image forming apparatus is extensively used today. A prior art electrophotographic copier, for example, has an image carrier in the form of a photoconductive element and a developing unit or similar processing unit which is located in close proximity to the drum. Usually, the developing unit has a toner container accommodating a toner or developer therein, and a developing roller supported by the toner container with a part thereof being exposed to the outside through an opening of the container. The toner container is constantly biased by a compression spring or similar biasing arrangement to maintain the developing roller in pressing contact with the drum. The developing unit is removably mounted on a body of the copier to facilitate replacement thereof which will be needed when the unit runs out of toner, maintenance, etc. Specifically, when the developing unit is mounted or dismounted, the toner container is guided by a guide arrangement in a direction in alignment with the direction, the developing roller is urged against the drum, i.e., in the horizontal direction or in the right-and-left direction. However, the toner container is not so constructed as to be movable up and down and is, therefore, not easily to handle. It will be apparent that a toner container capable of being lifted up or lowered straight down would promote efficient mounting and dismounting of the developing unit. It has been customary to provide some play between guide members which constitute the guide arrangement in order to allow the guide arrangement to guide the toner container smoothly. This is disadvantageous, however, in that the toner container is apt to shake up and down due to the play, resulting in the quality of an image being degraded. Further, substantial frictional resistance is developed between the biasing arrangement or compression spring and the toner container to disturb the smooth movement of the toner container in the horizontal direction. On the other hand, since the toner container is constantly biased toward the drum by the compression spring, it may occur that, when the toner container is spaced apart from the drum for mounting or dismounting the developing unit, the operator can inadvertently releases the toner container to cause the container and, therefore, the developing roller to hit against the drum due to the action of the spring. This would damage the developing roller and the drum. To avoid such an occurrence, one has to maintain the toner container spaced apart from the drum by hand throughout the replacement or maintenance, resulting in inefficient manipulations.

SUMMARY OF THE INVENTION

It is therefore an object of the present invention to eliminate the drawbacks particular to the prior art as discussed above.

It is another object of the present invention to provide an image forming apparatus which allows a processing unit to be readily and mounted and dismounted from a body thereof and thereby prevents the image quality from being degraded despite the mounting and dismounting operations.

It is another object of the present invention to provide an image forming apparatus which allows a processing unit to be moved upward when it is mounted or dismounted, thereby promoting efficient manipulations.

It is another object of the present invention to provide an image forming apparatus which allows a processing unit to be temporarily held in a retracted position spaced apart from an image carrier when it is mounted or dismounted.

It is another object of the present invention to provide a generally improved image forming apparatus having a removable processing unit.

In accordance with the present invention, an image forming apparatus comprises a body, an image carrier rotatably supported by the body for forming an electrostatic latent image on the surface thereof, a processing unit having a rotary body pressing against the surface of the image carrier, the processing unit being supported by the body movably toward and away from the image carrier, and a biasing arrangement for biasing the processing unit in a direction for pressing the rotary body of the processing unit against the image carrier, the processing unit being arranged such that reaction forces exerted in a vertical direction by the body on the processing unit are directed upward at all times.

Also, in accordance with the present invention, an image forming apparatus comprises a body, an image carrier rotatably supported by the body for forming an electrostatic latent image on the surface thereof, a processing unit having a rotary body pressing against the surface of the image carrier, the processing unit being supported by the body movably toward and away from the image carrier, a biasing arrangement for biasing the processing unit in a direction for pressing the rotary body of the processing unit against the image carrier, and a retracting means for retracting the processing unit to a position spaced apart from the image carrier when the condition of the rotary body of the processing unit is pressed against the image carrier is cancelled.

BRIEF DESCRIPTION OF THE DRAWINGS

The above the other objects, features and advantages of the present invention will become more apparent from the following detailed description taken with the accompanying drawings in which.

DESCRIPTION OF THE PREFERRED EMBODIMENTS

To better understand the present invention, a reference will be made to the prior art image forming apparatuses illustrated in FIGS. 1 and 2.

Figure 1:
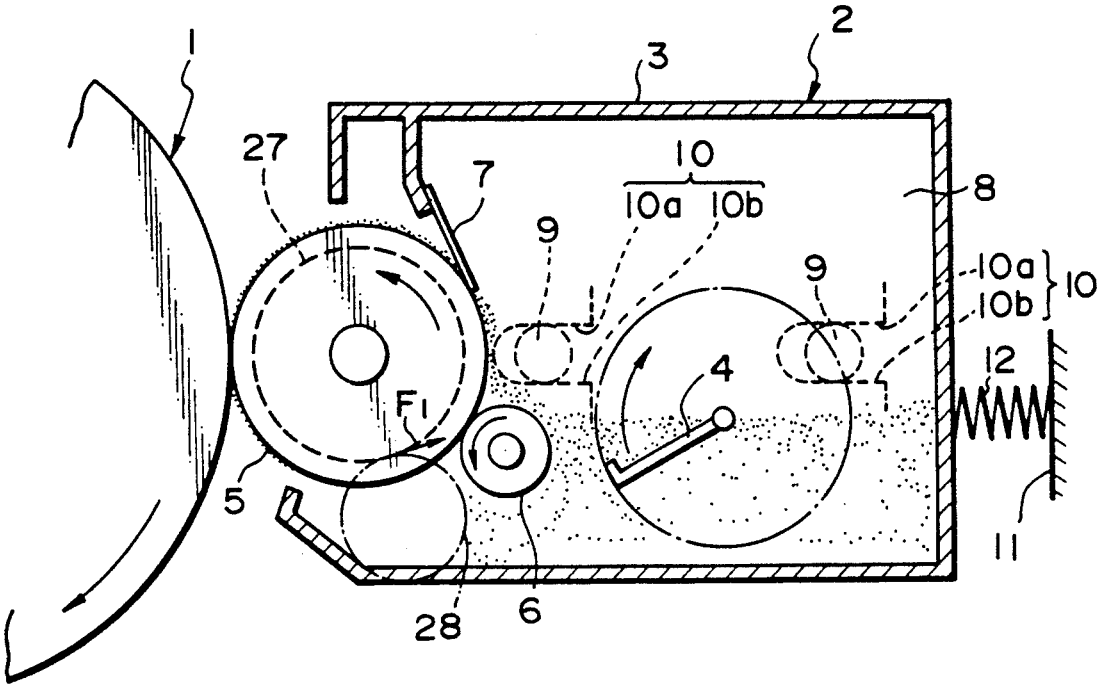
FIG. 1 PRIOR ART
FIG. 1 is a section showing a prior art image forming apparatus which is implemented as an electrophotographic copier.

FIG. 1 shows an electrophotographic copier belonging to a family of image forming apparatuses in which the above-described type of processing unit is removably installed. More specifically, FIG. 1 indicates an essential part of an electrophotographic copier having an image carrier comprising a photoconductive drum 1, and a processing unit in the form of a developing unit 2.

In FIG. 1, the drum 1 is rotatably but otherwise statically supported by structural members of the copier body and is rotated clockwise as viewed in the figure by a drive source (not shown). While the drum 1 is so rotated, its surface is charged to a predetermined polarity and, then, light from an image of an original document is focused by optics (not shown) to form an electrostatic latent image on the drum 1. The developing unit 2 deposits a toner to the latent image on the drum 1 as the latent image passes it, thereby turning the latent image into a toner image. The developing unit 2 has a toner container 3 storing the toner therein, an agitator 4 for agitating the toner inside the toner container 3, a developing roller 5 which is a specific form of a rotary body, and a toner supply roller 6 for supplying the toner to the developing roller 5. These components 4, 5 and 6 individually extend each having an axis of rotation which extends parallel to the axis of rotation of the drum 1 and are rotatably but otherwise statically supported by the toner container 3. The rotating directions of the components 4, 5 and 6 are indicted by arrows in FIG. 1. The toner container 3, therefore, provides a support which rotatably supports the developing roller, or rotary body 5. The toner deposited on the developing roller 5 by the toner supply roller 6 is regulated by a blade 7 to form a thin layer having a predetermined thickness while being charged to a predetermined polarity by friction. The charged toner is transported by the rotating developing roller 5 to a developing station where the drum 1 and roller 5 are pressed against each other. At this station, the toner is electrostatically transferred from the developing roller 5 to the latent image on the drum 1. The resulting toner image on the drum 1 is transferred to a paper sheet (not shown). Toner particles remaining on the drum 1 after such image transfer are collected by a cleaning unit (not shown).

The developing roller 5 is pressed against the drum 1 to effect contact development, as stated above. To attain a high-quality toner image by the contact development, it is preferable that the developing roller 5 be pressed against the drum 1 as uniformly as possible over the entire length thereof. In the light of this, the developing unit 2 is supported in such a manner as to be bodily movable toward and away from the drum 1 (in the horizontal direction in FIG. 1). Specifically, two guide rollers 9 are rotatably mounted on each of a pair of opposite side walls of the toner container 3, as shown in dotted lines for one side wall 8 in the figure. Each guide roller 9 is rollably received in a respective notch 10, the notches 10 being formed in opposite frame panels that form a part of the structure of the copier body. A biasing arrangement, in the form of a compression spring 12, is preloaded between the toner container 3 and a structural member 11 of the copier body. In this configuration, the developing unit 2 is constantly biased toward the drum 1 so as to maintain the developing roller 5 in pressing contact with the drum 1. This allows the developing roller 5 to remain in uniform contact with the drum 1 even if the outer periphery of drum 1 and/or that of the developing roller 5 is somewhat eccentric due to errors inherent in a production line or has some degree of undulation on its surface. More specifically, the developing roller 5 finely oscillates in the horizontal direction while adapting itself to the undulation, eccentricity and other irregularities of the surface of the drum 1 and/or those of its own surface.

The notches 10 which respectively receive the guide rollers 9 of the developing unit 2 are each provided with an upper guide surface 10*a* and a lower guide surface 10*b*, for the following reason. Various kinds of externally derived forces act on the developing unit 2 while the latter is in operation. Whether the force of external forces, except for reaction forces, acting on the developing unit 2 from the guide surfaces 10*a* and 10*b* is directed upward or downward depends on the design conditions of the developing unit and its associated constructions. Thus, the rollers 9 are guided by the notches 10, each having the upper and lower guide surfaces 10*a* and 10*b*, so that the developing unit 2 may remain in the predetermined position shown in FIG. 1 with no regard to the direction of the above-mentioned resultant force.

Figure 2:
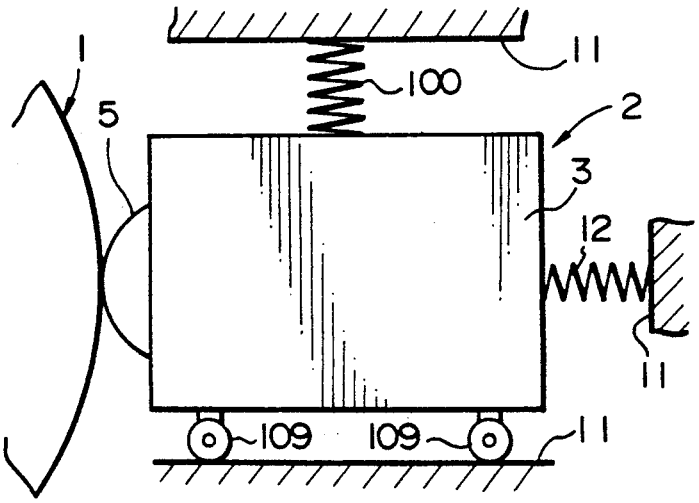
FIG. 2 PRIOR ART
FIG. 2 is a section showing another prior art electrophotographic copier.

FIG. 2 shows another prior art electrophotographic copier in which rollers 109 are fitted on the bottom of the toner container 3 of the developing unit 2. The rollers 109 are capable of rolling on the structural member 11 of the copier body. The toner container 2 is constantly biased downward by a compression spring 100 and thereby prevented from rising away from the structural member 11.

The developing unit 2 is removably supported by the copier body to facilitate replacement, maintenance, etc. For example, the developing unit 2 will be replaced with another when it runs out of the toner. To remove the developing unit 2 shown in FIG. 1, it is shifted to the right to release the guide rollers 9 from their associated notches 10 and then dismounted from the copier body. Concerning the developing unit 2 shown in FIG. 2, the springs 12 and 100 are removed, and then the developing unit 2 is shifted to the right, for example. By the opposite procedure, the same developing unit or a fresh developing unit may be mounted in the copier body.

With any of the prior art constructions, however, it is impossible to remove the developing unit 2 by moving it upward, resulting in poor manipulability. This is also true with the operation for mounting the developing unit 2. If the developing unit 2 shown in FIG. 1 or 2 could be mounted and dismounted simply by raising it or lowering it from the illustrated position, easy and efficient operations would be promoted. In the prior art arrangement shown in FIG. 1, the frame panels with the notches 9 in which the guide rollers 9 are received prevent the developing unit 2 from being lifted up in the illustrated condition. In the other prior art shown in FIG. 2, the structural member 11 on which one end of the spring 100 is seated blocks the upward movement of the developing unit 2.

Further, in the arrangement shown in FIG. 1, while each guide roller 9 is guided by the upper and lower guide surfaces 10*a* and 10*b* of its associated notch 10, some play is provided between the guide roller 9 and the guide surfaces 10*a* and 10*b* so as to insure smooth horizontal oscillations of the guide roller 9. Such a play is disadvantageous, however, in that when an upward force and a downward force act alternately on the developing unit 2 due to a change in the torque for driving the rollers 9 while the rollers 9 rotate, the developing unit 2 is caused to shake up and down by the amount of the play. Such shaking of the development unit 2 would effect the quality of a toner image to be formed on the drum 1. Another problem with the prior art of FIG. 2 is that when the developing unit 2 oscillates in the horizontal direction during operation, substantial frictional resistance is apt to act between the spring 100 and the toner container 3 to thereby prevent the unit 2 from moving smoothly in the horizontal direction.

A prerequisite with the prior art constructions shown in FIGS. 1 and 2 is that the developing unit 2 be mounted and dismounted with greatest care in order to prevent the developing roller 5 from hitting against and thereby damaging the surface of the drum 1. Specifically, when removes the developing unit 2 to the right in the figures and then inadvertently releases it, the developing roller 5 is apt to hit against the drum 1 under the action of the compression spring 12. This is also true with a case wherein the developing roller 5 is moved away from the drum 1 for some minor maintenance work, i.e., the developing unit 2 has to be spaced apart from the drum 1 throughout the work by holding it by hand, for example.

Figure 3:
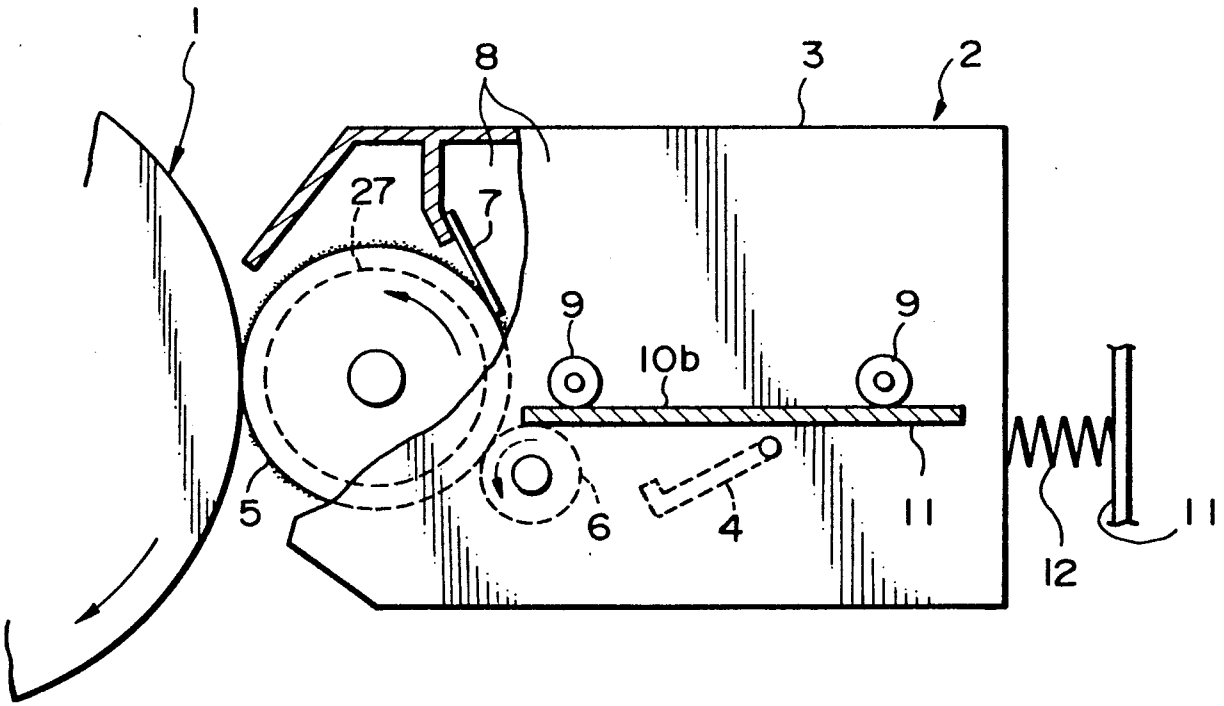
FIG. 3 is a fragmentary section of an image forming apparatus embodying the present invention, showing a relationship between a developing unit and a photoconductive drum of the apparatus.

Referring to FIG. 3, an image forming apparatus embodying the present invention is shown. The illustrative embodiment, like the prior art of FIG. 1, is implemented as a copier having an image carrier in the form of a photoconductive drum 1 and an image forming unit in the form of a developing unit 2. Since this embodiment is similar to the prior art of FIG. 1 with respect to the basic construction, the same components and structural elements are designated by the same reference numerals, and redundant description will be omitted for simplicity.

In FIG. 3, guide rollers 9, rotatably mounted on the outer surfaces of opposite side walls 8 of a toner container 3 are supported at their lower ends only by guide surfaces 10*b* which are formed by a structural member 11 of the copier body. That is, no obstructions exist above the rollers 9. Such guide rollers 9 may of course be fitted on the bottom of the toner container 3, as shown in FIG. 2. In this case, too, it is not necessary to provide the spring 100 for biasing the toner container 3 and the structural member 11 for receiving the upper end of the spring 100 above the developing unit 2. In this manner, the developing unit 2 is supported by the copier body from below and not pressed from above. In this embodiment, such a configuration is realized by arranging the developing unit 2 such that the reaction forces exerted by the copier body on the developing unit 2 are directed upward (opposite to the direction of gravity) without exception. Stated another way, the various components of the developing unit 2 are positioned such that the resultant force of external forces which may act on the developing unit 2, except for the above reaction forces, is disclosed downward (direction of gravity). This kind of arrangement is successful in supporting the developing unit stably on the copier body without the need for the guide surfaces 10*a*, compression spring 100 or the spring seat otherwise located above the developing unit 2. The developing unit 2, therefore, is supported with high accuracy and capable of producing high-quality toner images stably over a long period of time. The illustrative embodiment allows one to readily remove the developing unit 2 from the copier body by simply raising it. In addition, the developing unit 2 is free from the previously discussed shaking and the increase in frictional resistance which is ascribable to the spring 100 (FIG. 2).

Hereinafter will be described a specific implementation for directing the reaction forces acting in the vertical direction on the developing unit 2 upward at all times as stated above.

Figure 4:
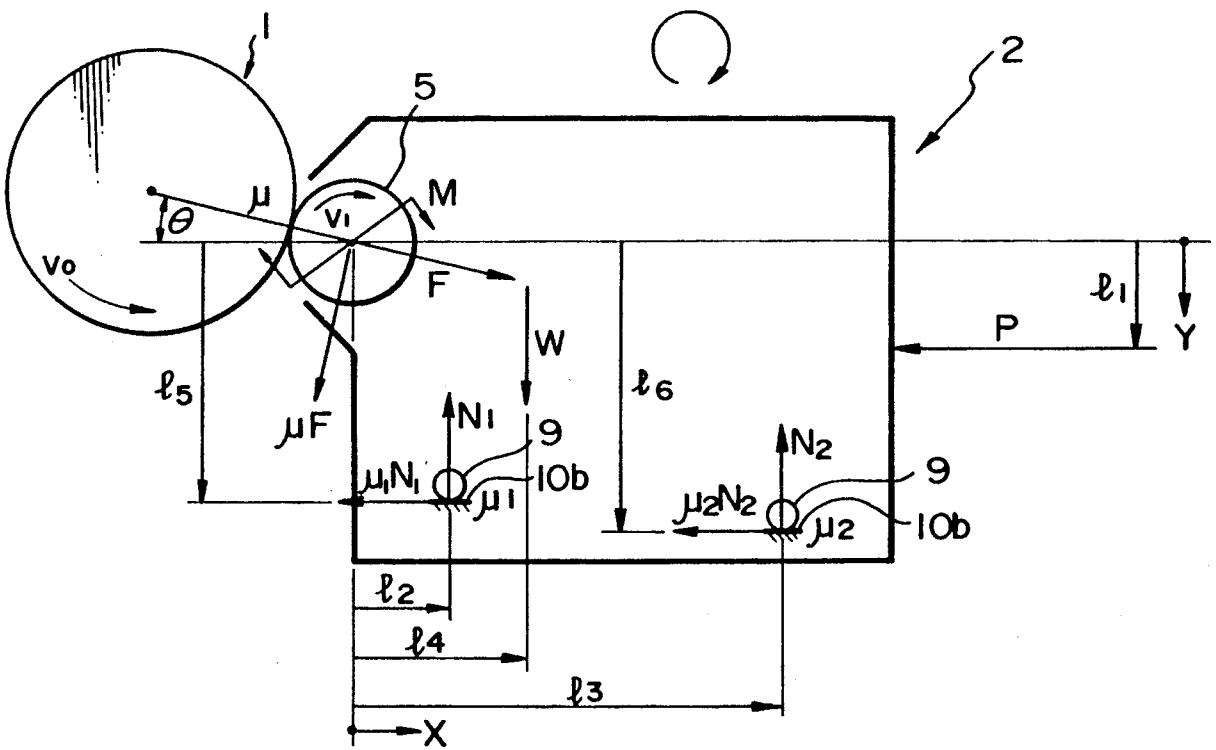
FIG. 4 is a diagram schematically showing various external forces and moments which act on the developing unit.

FIG. 4 shows the construction of FIG. 3 schematically and in a more generic form. As shown, assume that the drum 1 rotates at a speed of $v_o$, and the developing roller 5 rotates at a speed of $v_1$ which is higher than $v_0$. While the rotating directions of the drum 1 and developing roller 5 are shown as being opposite to those shown in FIG. 3, this is simply for the ease of description and they may of course be the same as the latter. The developing unit 2 has a weight W which acts on itself, while reaction forces $N_1$ and $N_2$ act on the guide rollers 9 from the guide surfaces 10*b* of the copier body. Further, assume that the spring 12 (FIG. 3) exerts a pressure P on the developing unit 2, and that the drum 1 exerts a pressure F on the developing roller 5. Since the speed $v_1$ of developing roller 5 is higher than the speed $v_0$, a frictional force of $\mu F$ acts on the center of the developing roller (where $\mu$ is the coefficient of friction between the drum 1 and the roller 5). Let the downward direction and the rightward direction perpendicular to the downward direction in FIG. 4 be termed a Y positive direction and an X positive direction, respectively. The positions and angle of the points where the above-stated various forces act are labeled $l_1$, $l_2$, $l_3$, $l_4$, $l_5$, $l_6$ and $\theta$. The drive torque of the developing roller 5 is assumed to be M. When the developing roller 5 is operatively connected to the toner supply roller 6 and agitator 4 for driving the latter as shown in FIG. 3, the drive torque M will of course include extra torque associated with the roller 6 and agitator 4. Assuming that the coefficients of friction between the guide rollers 9 and the guide surface 10*b* are $\mu_1$ and $\mu_2$, respectively, the following equations hold with respect to the X and Y directions:

$$P \pm \mu_1 |N_1| \pm \mu_2 |N_2| - F\cos\theta + \mu F\sin\theta = 0 \quad \text{(Eq. (1)}$$

$$W - N_1 - N_2 + \mu F\cos\theta + F\sin\theta = 0 \quad \text{Eq. (2)}$$

Concerning the moments, there holds:

$$Wl_4 \pm Pl_1 \pm \mu_1 |N_1| l_5 \pm \mu_2 |N_2| l_6 + M - N_1 l_2 - N_2 l_3 = 0 \quad (3)$$

In the above equations, the sign "±" indicates that while the developing unit 2 oscillates, it assumes the sign "+" when moved toward the drum 1 and the sign "−" when moved away from the drum 1.

Figure 5:
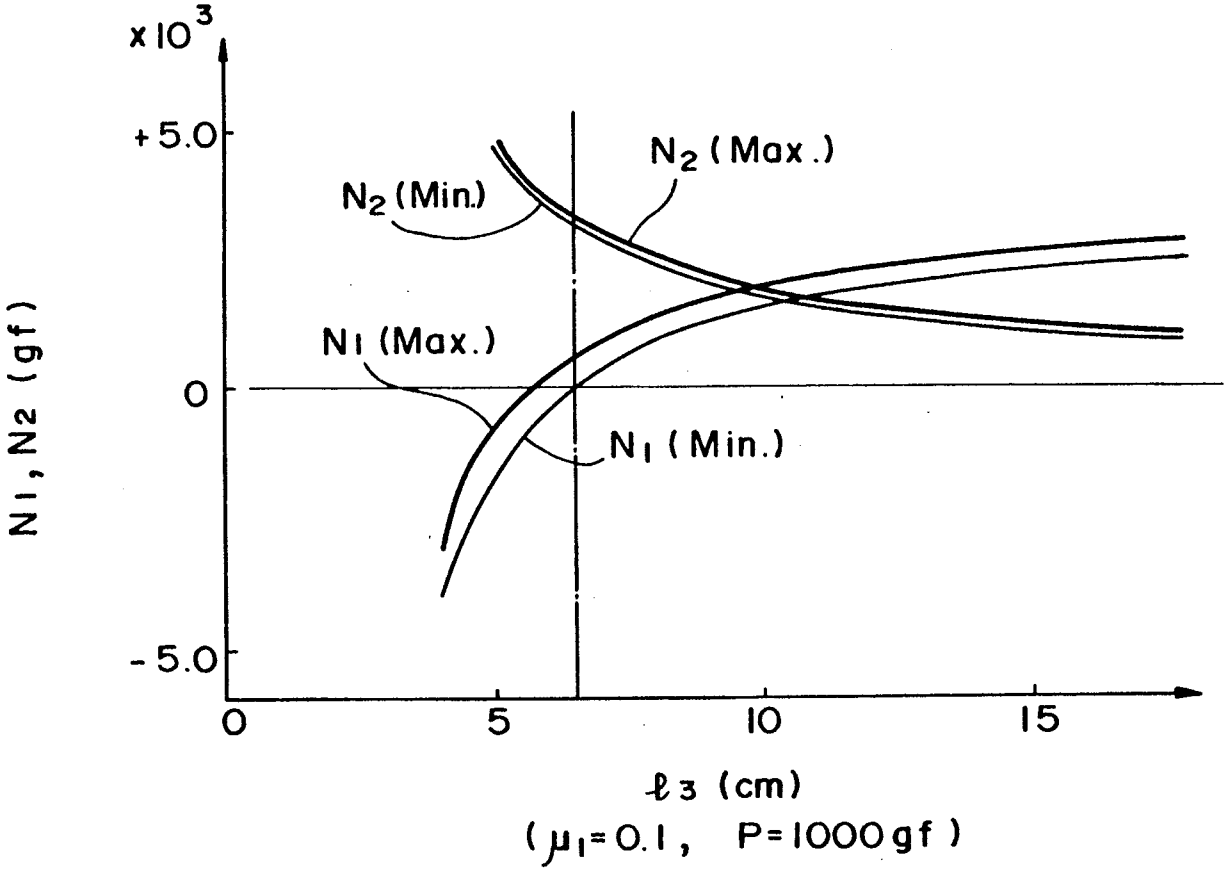
FIG. 5 is a graph showing a specific relationship between the position of components of the developing unit and reaction forces.

As stated above, the various forces act on the developing unit 2 in various directions are related as represented by the Eqs. (1) to (3). If such forces and torque are calculated and if $l_1$ to $l_6$ and the like are selected such that the resultant force of the reaction forces $N_1$ and $N_2$, in the vertical direction which the developing unit 2 receives from the guide surfaces 10*b* of the copier body are constantly directed upward (opposite to the direction of gravity), i.e., in the negative direction as viewed in FIG. 4, it is possible to guide the developing unit 2 stably along the guide surfaces 10*b* simply by laying the unit 2 on the guide surfaces 10*b*. This eliminates the need for the extra elements for biasing the developing unit 2 upward (upper guide surfaces shown in FIG. 1 spring 100 shown in FIG. 2, etc.). FIG. 5 is a graph in which the abscissa indicates the distance $l_3$, for example, and the ordinate indicates the reaction forces $N_1$ and $N_2$. As shown, the reaction forces $N_1$ and $N_2$ individually vary in association with the distance $l_3$. It is to be noted that "max" and "min" shown in FIG. 5 are representative of the maximum values and minimum values of the reaction forces $N_1$ and $N_2$ which result from the variations of the force acting on the developing unit 2 due to the previously stated oscillation of the unit 2 relative to the drum 1. Based on the graph of FIG. 5, a distance $l_3$ which causes the reactions $N_1$ and $N_2$ to act upward without exception can be selected. The other factors can be determined in the same manner as the distance $l_3$.

Figure 6:
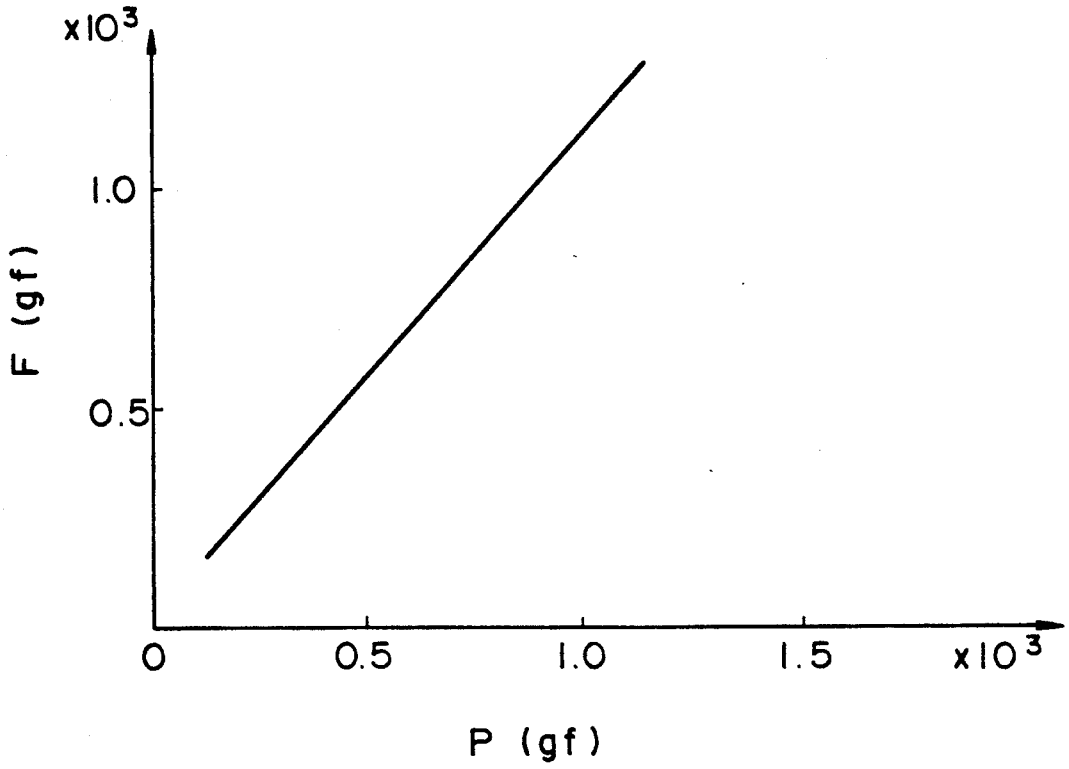
FIG. 6 is a graph showing a relationship between a biasing force exerted by a spring and a pressure developed between the drum and a developing roller.

In the Eqs. (1) to (3), the weight W includes the weight of the toner which is stored in the toner container 3, and therefore it varies with the amount of toner existing in the toner container 3. This of course has to be taken into account. Preferably, the force F exerted by the drum 1 on the developing roller 5, i.e., the pressure acting between the drum 1 and the roller 5 is selected to be about 20 grams per centimeter to 40 grams per centimeter. The pressure F varies with the biasing force P of the spring 12. FIG. 6 indicates a specific relationship between the biasing force P and the pressure F obtained with a coefficient of friction $\mu_1$ of 0.1. While the pressure F depends on the position of the developing unit 2 which oscillates, FIG. 6 indicates the center values.

While the illustrative embodiment has the developing unit 2 supported by the copier body through the guide rollers 9, the developing unit 2 may alternatively be provided with sliders which are slidable on and along the guide surfaces 10*b*. The number of such guide rollers or sliders is open to choice (one or more). If desired, the developing unit may be supported by the copier through a unit support member which is movable toward and away from the drum together with the developing unit, as will be described hereinafter.

Figure 7:
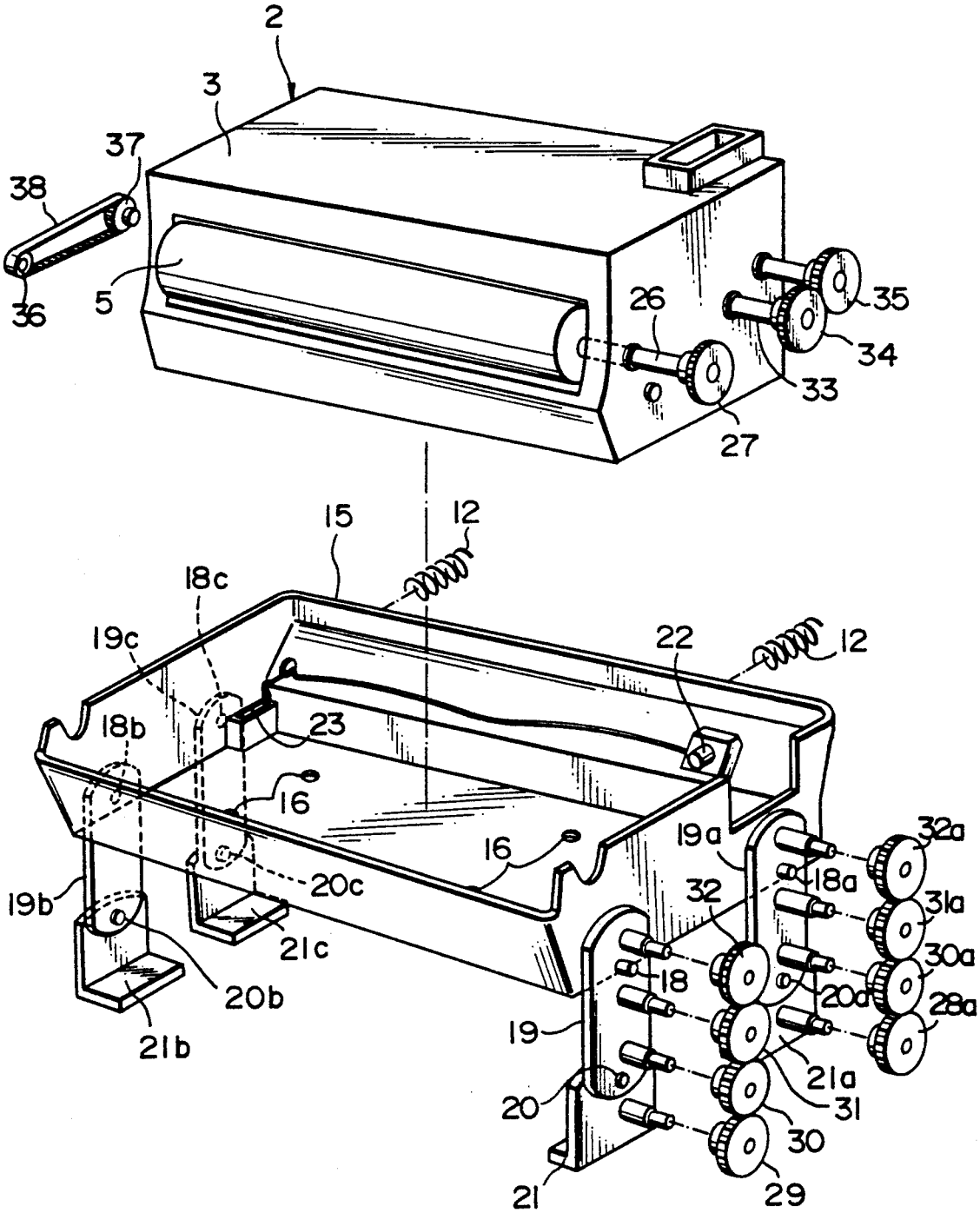
FIG. 7 is an exploded perspective view showing an alternative embodiment of the present invention.
Figure 8:
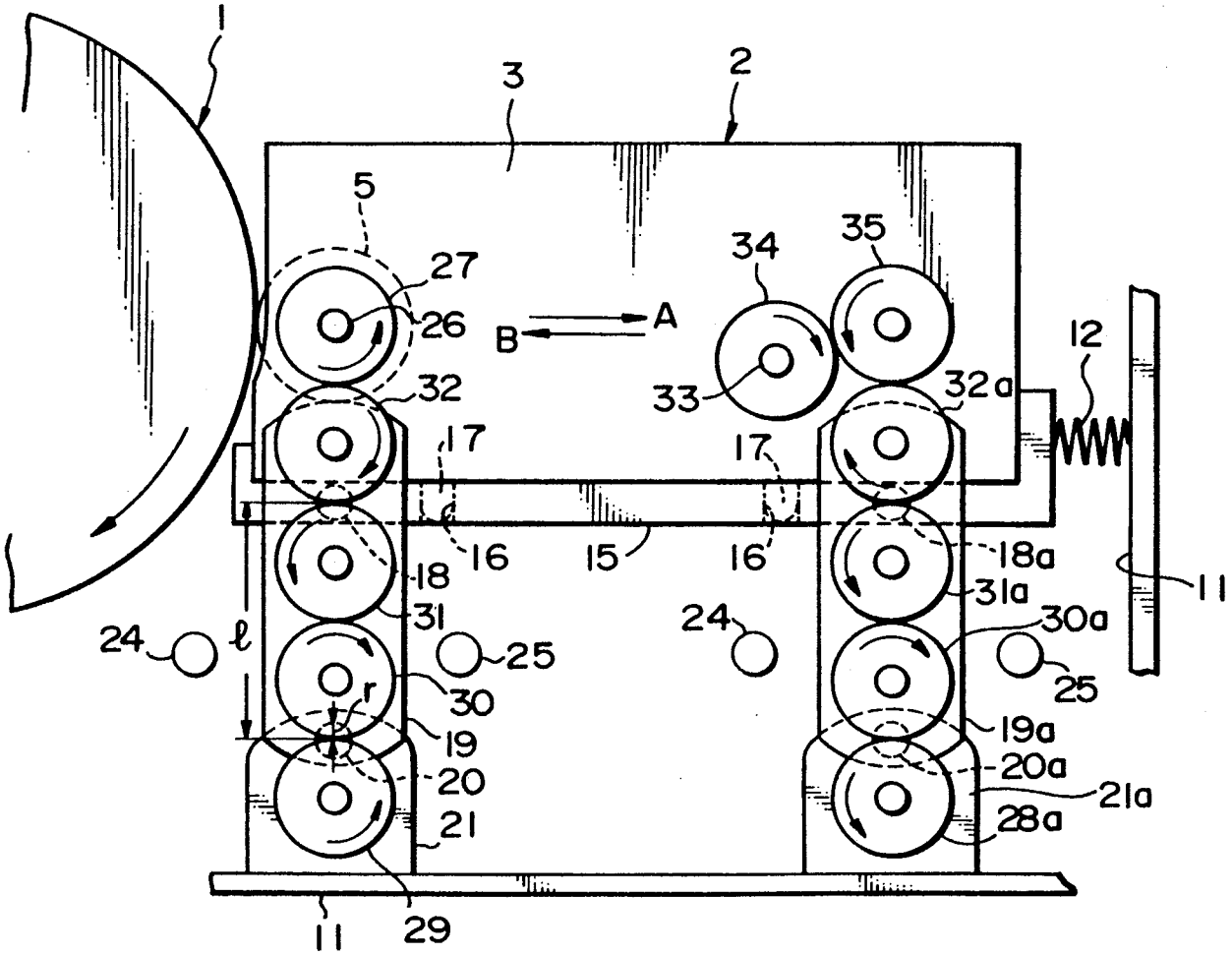
FIG. 8 is an elevational view showing the apparatus of FIG. 7 in an assembled condition.

Referring to FIGS. 7 and 8, an alternative embodiment of the present invention is shown and includes a generally dish- or bucket-like unit support member 15. The entire developing unit 2 is supported by the unit support member 15. A suitable number of positioning holes 16 are formed through the bottom of the unit support member 15. Lugs 17 extend out from the underside of the toner container 3 of the developing unit 2 and are individually received in the positioning holes 16. When the lugs 17 are received in the holes 16 as shown in FIG. 8, the developing unit 2 is unmovably positioned relative to the unit support member 15 and, yet, it can be removed from the unit support member 15 when simply raised away from the latter. In this manner, the developing unit 2 is retained by the unit support member 15. Four links implemented as link plates 19, 19*a*, 19*b* and 19*c* are individually rotatably connected at their upper ends to the unit support member 15 by upper pins 18, 18*a*, 18*b* and 18*c*. Extending downward from the unit support member 15, the link plates 19, 19*a*, 19*b* and 19*c* are respectively rotatably connected at their lower ends to brackets 21, 21*a*, 21*b* and 21*c* through their lower pins 20, 20*a*, 20*b* and 20*c*. In this configuration, the unit support member 15, the link plates 19, 19*b*, 19*c* and 19*d* and the structural member 11 of the copier body constitute a four-articulation rotary linkage, i.e., a parallel motion mechanism in the illustrative embodiment. Hence, the unit support member 15 is supported by the copier body in such a manner as to be movable toward and away from the drum 1 as indicated by arrows B and A of FIG. 8 while supporting the developing unit 2 unmovably.

The compression spring 12 serving as the biasing arrangement is preloaded between the rear end of the unit support member 15 and the structural member 11 of the apparatus body. The spring 12 constantly biases the unit support member 15 such that the developing roller 5 presses itself against the drum 1. Therefore, as in the previous embodiment, the developing roller 5 is held in uniform contact with the drum 1 throughout its length by oscillating in the direction A and B, (see FIG. 8), conformity to the errors and irregularities of the roller 5 and drum 1. This allows a toner image of high quality to be produced on the surface of the drum 1. The oscillating stroke of the developing roller 5 is the same as in the previous embodiment, e.g. about 0.1 millimeter. Preferably, the spring 12 is located at two spaced positions of the unit support member 15 shown in FIG. 3 which are symmetrical in the right-and-left direction, or at the intermediate between such two positions, in order to bias the support member 15 evenly in the above-mentioned direction. If desired, the compression spring 12 may be replaced with a coiled torsion spring and a pressing arm which is urged by the torsion spring against the unit support member 15. Further, even a leaf spring or similar resilient member may be substituted for the compression spring 12. Such modifications of course apply to the previous embodiment also. The unit support member 15 is provided with a toner end sensor 22 responsive to the exhaustion of the toner in the developing unit 2, and terminals 23 for applying bias voltages to the developing roller 5 and toner supply roller (see FIG. 3). The rest of the construction and the developing operations are the same as those of the previous embodiment.

When the developing unit 2 is mounted on the copier body through the unit support member 15 which is movable toward and away from the drum 1 together with the unit 2, the various components should also be dimensioned and arranged such that reaction forces acting in the vertical direction on the developing unit 15 from the unit support member 15 are directed upward at all times. Again, this makes it needless to press the developing unit 2 from above and, therefore, allows one or remove the developing unit 2 by simply lifting it up away from the unit support member 15 and to set it by simply lowering it onto the unit support member 15. The sensor 22 and terminals 23 provided on the unit support member 15 do not interfere with such movements of the developing unit 2 at all. Of course, the configuration of the unit support member 15 may be so modified as to allow the developing unit 2 to be mounted and dismounted in a direction perpendicular to the sheet surface of FIG. 4 or in the right-and-left direction, for example. This embodiment, therefore, enhances the design freedom noticeably, compared to the prior art. Since the spring 12 acts on the unit support member 15 and not on the developing unit 2, the developing unit 2 can be mounted and dismounted without the spring 12 being removed. Furthermore, while the developing unit 2 oscillates, it is free from the frictional forces which have heretofore acted on the rollers 9 (FIG. 1). Hence, when a new developing unit is mounted on the unit support member 15, its developing roller will be pressed against the drum 1 by the same pressure as the developing roller 5 of the old developing unit 5, guaranteeing high-quality toner images at all times.

Assume that the developing unit 2 shown FIG. 3 or any of the prior art developing unit 2 shown in FIGS. 1 and 2 is replaced with a new developing unit as shown in FIG. 3. Then, if the guide rollers 9 of the new developing unit are different from those of the old developing unit as to the diameter and surface conditions due to production errors, the new and old units will differ from each other with respect to the frictional force to be developed during the horizontal oscillation and, therefore, with respect to the force to be exerted by the developing roller on the drum 1. This is apt to effect the quality of a toner image.

In the construction shown in FIG. 8, the terminals 2 and sensor 22 are fitted on the unit support member 15 which is movable integrally with the developing unit 2. Hence, the terminals 23 and sensor 22 and the developing unit 2 are free from sliding resistance while the unit 2 is moved, insuring uniform contact of the developing roller 5 and drum 1. In addition, electrical connection of the terminals 23 and sensor 22 with the developing unit 2 is guaranteed.

Figure 9:
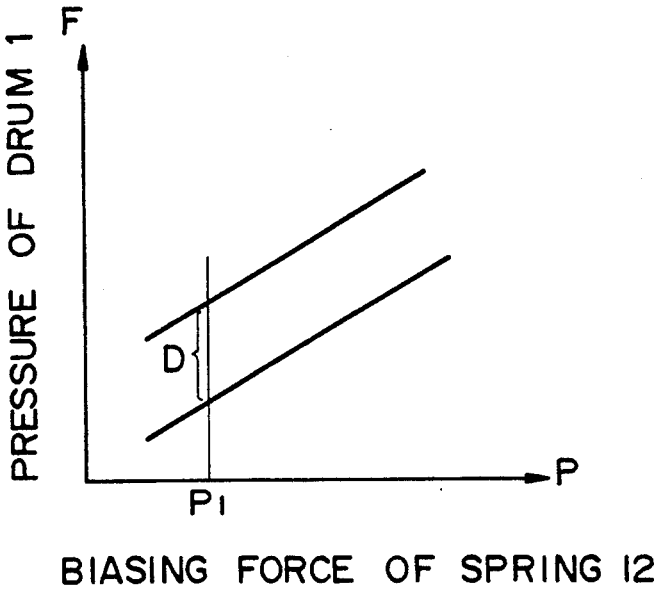
FIG. 9 is a graph showing how the pressure acting between a drum and a developing roller varies.
Figure 10:
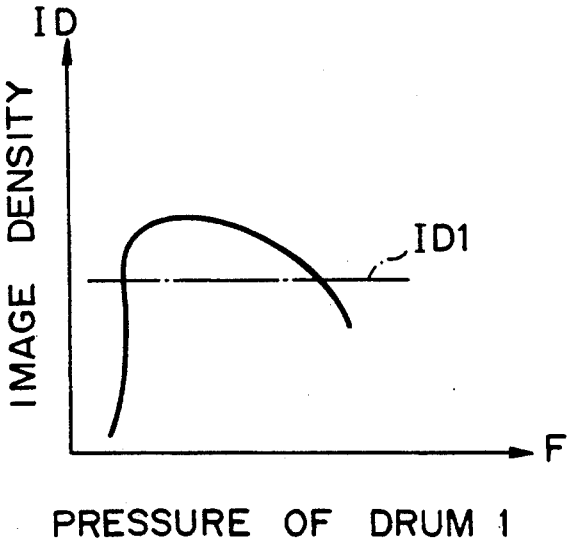
FIG. 10 is a graph showing a specific relationship between the pressure and the image quality.

Another advantage attainable with the four-articulation rotary linkage shown in FIGS. 7 and 8 is discussed here. As discussed earlier, when the developing unit shown in FIG. 4 oscillates horizontally relative to the drum 1, the pressure F acting therebetween varies. As shown in FIG. 9, even if the biasing force P exerted by the spring 12 is maintained constant as at $P_1$, the pressure F exerted by the drum 1 on the developing roller 5 varies over a range D. This is apt to cause the density of the toner image formed on the drum 1 to vary, preventing an image of uniform density from being produced. FIG. 10 is a graph useful for understanding such an occurrence. In FIG. 10, the ordinate indicates the image density ID, the abscissa indicates the pressure F, and ID1 is representative of the minimum image density generally needed. As the graph indicates, the image density changes with the pressure F and, in the worst case, critically lowers the entire image quality.

Figure 11:
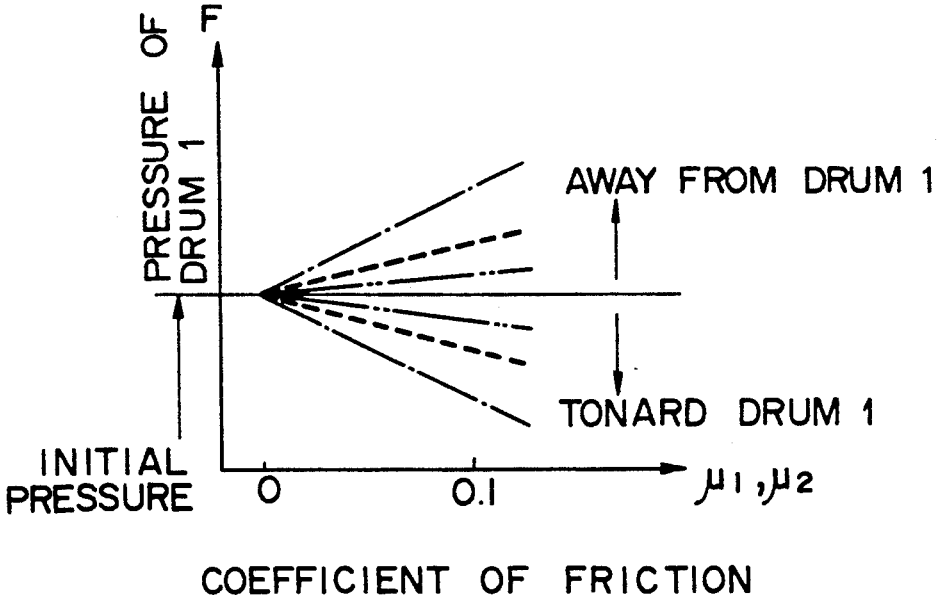
FIG. 11 is a graph useful for understanding that the range over which the pressure acting between a developing roller and a drum is variable depends on the weight of a developing unit.

The variation in the pressure F will be reduced if the weight W of the developing unit 2 and, therefore, the reaction forces $N_1$ and $N_2$ acting on the unit 2 from the copier body are reduced to in turn reduce the coefficients of friction $\mu_1$ and $\mu_2$. However, such factors cannot be reduced beyond a certain limit. FIG. 11 is a graph showing a relationship between the pressure F and the coefficients of friction $\mu_1$ and $\mu_2$ with respect to different weights W. Specifically, when the weight W of the developing unit 2 is comparatively heavy, the pressure F and the coefficients of friction $\mu_1$ and $\mu_2$ are related as represented by dash-and-dot lines which are individually associated with the movements of the developing unit 2 away from and toward the drum 1. When the weight W is comparatively light, they are related as represented by dash-and-dot lines. Further, when the weight W is medium, they are related as represented by dashed lines. As FIG. 11 indicates, the heavier the weight W of the developing unit 2 and the greater the coefficients of friction $\mu_1$ and $\mu_2$, the greater the range of fluctuation of the pressure F and the more prominent the variation in image density becomes.

By supporting the unit support member 15 through the link plates in a four-articulation rotary linkage configuration as shown in FIGS. 7 and 8, the problem discussed above can be reduced effectively to thereby suppress the variation in the pressure acting between the developing roller 5 and the drum 1. Specifically, in the construction shown in FIG. 8, when the developing unit 2 and support member 15 are oscillated in the directions A and B, frictional resistance is developed at the pins 20, **20*a*, 20*b* and 20*c*. However, such frictional resistance is reduced to the ratio of the radius r of the pins to the lever length l of the link plates before it is imparted to the unit support plate 15. Hence, the developing unit 2 is little influenced by the frictional resistance during its oscillation, as if the coefficients of friction $\mu_1$ and $\mu_2$ were reduced to a considerable degree. It follows that the range of variation of the pressure acting between the drum 1 and the developing roller 5** is reduced to remarkably enhance the uniform density distribution of the resulting toner image.

The four-articulation rotary linkage shown in FIG. 7 allows the unit support member 15 and developing roller 5 to oscillate by adapting themselves to any difference in surface condition (undulation, eccentricity, etc) between the roller 5 and the drum 1 which may exist at opposite ends of the roller 5. More specifically, the unit support member 15 is elastically deformable to some extent, and its opposite ends, as viewed in a direction perpendicular to the sheet surface of FIG. 8, are oscillatable to some extent independently of each of due to some play provided between the link plates and the pins. Hence, the above-mentioned opposite ends of the unit support member 15 are oscillatable independently of each other by adapting itself to the surface conditions of the developing roller 5 and drum 1, whereby the roller 5 is constantly held in intimate contact with the drum 1 over the entire length thereof.

In the embodiment shown in FIG. 8, the developing roller 5 developing a latent image while rotating and, therefore, it has to be driven in a rotary manner. It has been customary to mount a gear 27 on one end of the shaft 26 of the developing roller 5, the gear 27 being rotated to in turn rotate the developing roller 5. In the prior art shown in FIG. 1, a driver gear 28 is rotatably mounted on the copier body and held in mesh with the gear 27. A motor (not shown) is mounted on the copier body to drive the gear 28 and thereby the developing roller 5 via the gear 27. This kind of gearing has the following disadvantage. Specifically, when the rotation of the drive gear 28 is transmitted to the gear 27, the gear 28 exerts a force F1 on the gear 27 (FIG. 1) which is offset by the pressure angle from the common tangential direction of the gears 27 and 28. Let this force F1 be called a tangential force for convenience. When the tangential force F1 acts on the developing roller 5 which is oscillatable relative to the copier body, the roller 5 is urged away from the drum 1. More specifically, a component of tangential force F1 which is directed away from the drum 1 urges the drum 1 away from the drum 1. On the other hand, no driving forces act on the other end of the shaft of the developing roller 5, i.e., the tangential force F1 acts only on one end of the developing roller 5. Such an unbalanced force distribution is apt to prevent the developing roller 5 from contacting the drum with a uniform pressure over the entire length thereof.

In FIG. 1, the tangential force F1 is shown as acting in a direction for urging the developing roller 5 away from the drum 1. However, it may occur that the tangential force urges the developing roller 5 toward the drum 1, depending upon the intermeshing position of the gears 27 and 28 or the rotating direction of the developing roller 5.

The illustrative embodiment shown in FIGS. 7 and 8 is constructed to eliminate the above-discussed drawback as well. As shown in FIGS. 7 and 8, a drive gear 29 is rotatably mounted on the copier body, i.e., the bracket 21 in this particular embodiment. A motor (not shown) is mounted on the copier body and drivably connected to the gear 29 to rotate it counterclockwise as viewed in FIG. 8. Intermediate gears 30, 31 and 32 are rotatably mounted on the link plate 19. The drive gear 29 drives the gear 27 counterclockwise via the three intermediate gear 30, 31 and 32. The mesh point of the drive gear 29 and first intermediate gear 30, i.e., the contact point within the pitch of the gears 29 and 30 is coincident with the pin 20 about which the link plate 19 is rotatable.

When the rotation of the drive gear 29 is transmitted to the intermediate gear 30, a tangential force act on the intermediate gear 30, as discussed with reference to FIG. 1. Nevertheless, this tangential force is received by the pin 20 because the point where the force is transmitted from the gear 29 to the gear 30 is coincident with the center of rotation of the link plate 19. In this condition, the tangential force does not urge the developing roller 5 toward or away from the drum 1, i.e., only the rotation is transmitted to the developing roller 5 via the gears 30, 32 and 27. This eliminates the occurrence that the pressure exerted by the developing roller 5 on the drum 1 is increased and decreased by the tangential force F1 at one end of the roller 5, thereby insuring a toner image having a uniform density.

The agitator 4 incorporated in the toner container 3 (see FIG. 3) may be driven by the developing roller 5. In the illustrative embodiment, however, a gear 34 is mounted on an agitator shaft 33, and a gear 35 is rotatably mounted on the side wall of the toner container 3 and held in mesh with the gear 34. A drive gear 28*a* is rotatably mounted on the bracket 21*a* and drives the gears 35 via three intermediate gears 30*a*, 31*a* and 32*a* which are rotatably mounted on the link plate 19*a*. By such a gearing, the agitator 4 is driven in a rotary motion in a predetermined direction. In this configuration, a tangential force is also exerted by the gear 28*a* on the first intermediate gear 30*a*. Preferably, therefore, the meshing point of the gears 30*a* and 28*a*, i.e., the transmission point is positioned to coincide with the pin 20*a* about which the link plate 19*a* is rotatable, so that the tangential force may be prevented from reaching the drum 1 via the developing roller 5.

As shown in FIG. 7, in the illustrative embodiment, the toner supply roller 6 (see FIG. 3) is driven in a rotary motion by a belt 38 which is passed over pulleys 36 and 37. The pulleys 36 and 37 are rigidly mounted on the shaft of the developing roller 5 and the shaft of the toner supply roller 6, respectively.

The intermediate gears 30, 31 and 32 provided on the link plate 19 are omissible. Specifically, the drive gear 28 may be directly meshed with the developing gear 27 only if the force transmission point of the gears 28 and 27 is positioned to coincide with the center of rotation of the link plate 19 or with the pin 20. This also true with the gear train associated with the agitator 4. Such a construction wherein the point where a driving force is inputted to the developing unit is coincident with the connecting point of the link of the four-articulation rotary linkage and the copier body to prevent a tangential force from acting between the developing roller 5 and the drum 1 may be implemented in various forms. The various gears shown and described do not interfere with the mounting and dismounting of the developing unit 2 at all. Specifically, when the developing unit 2 is removed from the unit support member 15, the gear 27 associated with the developing roller 5 will readily separate from the intermediate gear 32; when the unit 2 is set on the support member 15, the gears 27 and 32 will readily mesh with each other.

As described above, even when the developing unit 2 has a substantial weight, the embodiment of FIGS. 7 and 8 insures the uniform contact of the developing roller 5 with the drum 1 by any of the various configurations states above. The pressure acting between the developing roller 5 and the drum 1 can be controlled to a predetermined value only if the force of the spring 12 is selected adequately.

Figure 12:
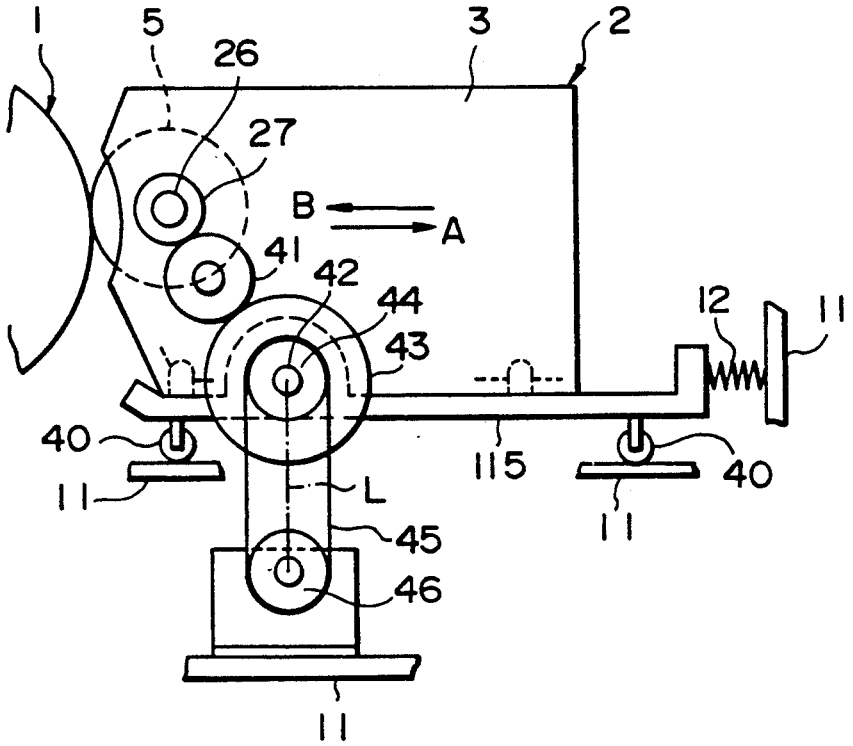
FIG. 12 is a view similar to FIG. 8, showing another alternative embodiment of the present invention.

Referring to FIG. 12, another alternative embodiment of the present invention is shown. As shown, a unit support member 115 supports the developing unit 2 removably but statically. A suitable number of rollers 40 are rotatably mounted on the underside of the unit support member 115. The rollers 40 are rollably supported by the structural member 11 of the copier body or by guide rails which are mounted on the structural member 11, so that the unit support member 115 is movable toward and away from the drum 1. The unit support member 115 is constantly biased toward the drum 1 by the spring 12, maintaining the developing roller 5 in uniform pressing contact with the drum 1. The reaction forces exerted by the unit support member 115 on the developing unit 2 in the vertical direction are directed upward at all times, as in the embodiment of FIGS. 7 and 8. The developing unit 2, therefore, is constantly guided in a stable manner without being pressed from above and may be mounted and dismounted in the vertical direction or any other desired direction. Concerning the other advantages such as that the developing unit 2 is free from the resistance of the terminals (see FIG. 7), the embodiment of FIG. 12 is comparable with the embodiment of FIGS. 7 and 8.

The developing roller 5 shown in FIG. 12 is driven by a gearing which is composed of the gear 27 mounted on the shaft of the roller 5, an intermediate gear 41 meshing with the gear 27 and mounted on the toner container 23, an intermediate gear 43 mounted on a shaft 42 which is journalled to the unit support member 115, a pulley 44 rigid on the shaft 42, a belt 45 passed over the pulley 44, and a pulley 46 rotatably mounted on the copier body and over which the belt 45 is also passed. The pulley 46 is driven by a motor (not shown) which is mounted on the copier body. The rotation of the pulley 46 is transmitted to the developing roller 5 by way of the above-mentioned gearing. A line L interconnecting the centers of the pulleys 44 and 46 is substantially perpendicular to the directions A and B in which the unit support member 115 is oscillatable toward and away from the drum 1. Hence, although a force corresponding to the tangential force shown in FIG. 1 acts on the pulley 44 while the rotation is imparted to the pulley 44 by the belt 45, its direction is perpendicular to the directions A and B, i.e., parallel to the line L. This force, therefore, does not serve to urge the developing roller 5 toward or away from the drum 1. It follows that the developing roller 5 is substantially preventing from contacting the drum 1 more strongly or weakly at one end than at the other end, despite that the roller 5 is driven at one end only. If desired, the belt 46 and pulleys 44 and 46 may be replaced with a pair of sprockets and a chain passed over the sprockets.

Figure 13:
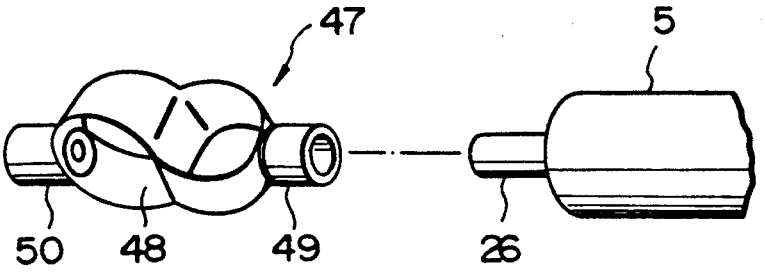
FIG. 13 is a perspective view of a universal joint.

As shown in FIG. 13, the developing roller 5 may be driven by a universal joint 47 instead of the belt 45 and pulleys 44 and 46. The universal joint 47 which per se is well known in the art has an elastic member 48 made of rubber, for example. The universal joint 47 is rigidly connected at one end 49 to the shaft 26 of the developing roller 5 and at the other end 50 to a shaft of a gear (not shown) of the copier body which is driven by a motor that is mounted on the copier body. In such an alternative configuration, the developing roller 5 is also prevented from contacting the drum 1 more strongly or more weakly at one end than at the other. An Aldahm joint may be substituted for the universal joint 47, if desired.

The gear train shown in FIGS. 7 and 8 may be replaced with the pulley and belt device shown in FIG. 12 or the universal joint shown in FIG. 13 to impart only the moment to the developing roller 5.

Figure 14:
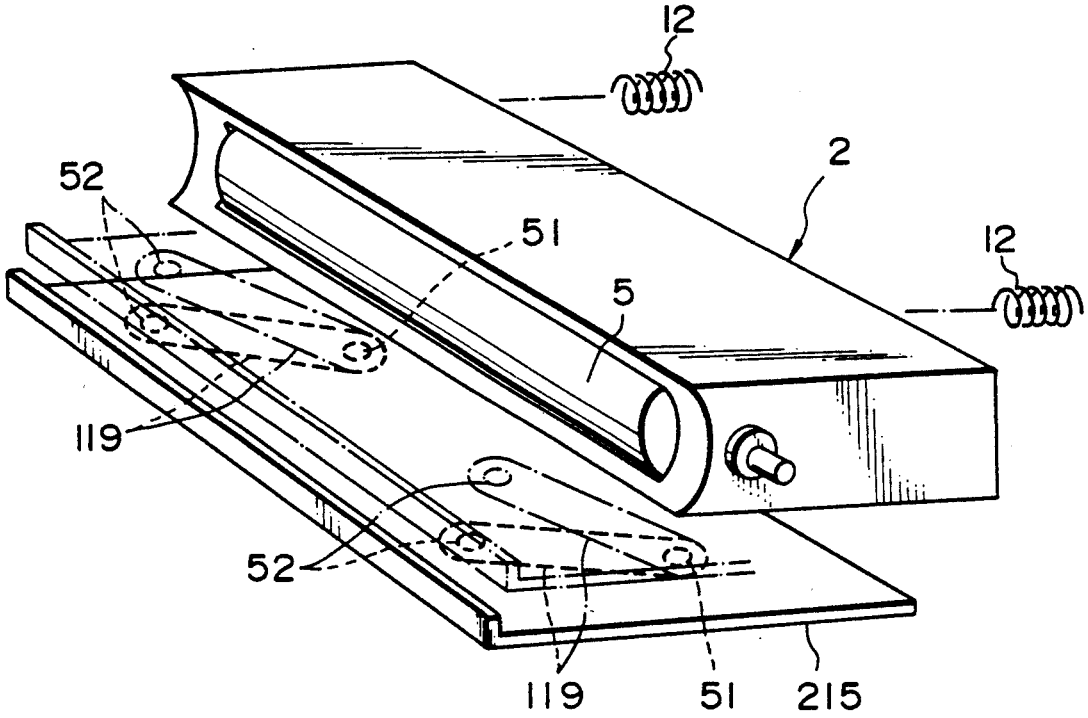
FIG. 14 is a view similar to FIG. 7, showing another alternative embodiment of the present invention.
Figure 15:
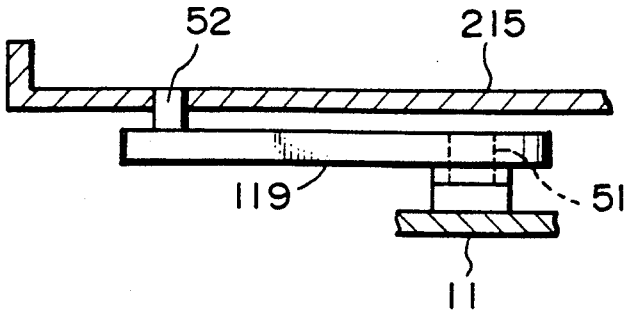
FIG. 15 is a sectional view of a unit support member included in the embodiment of FIG. 14.
Figure 16:
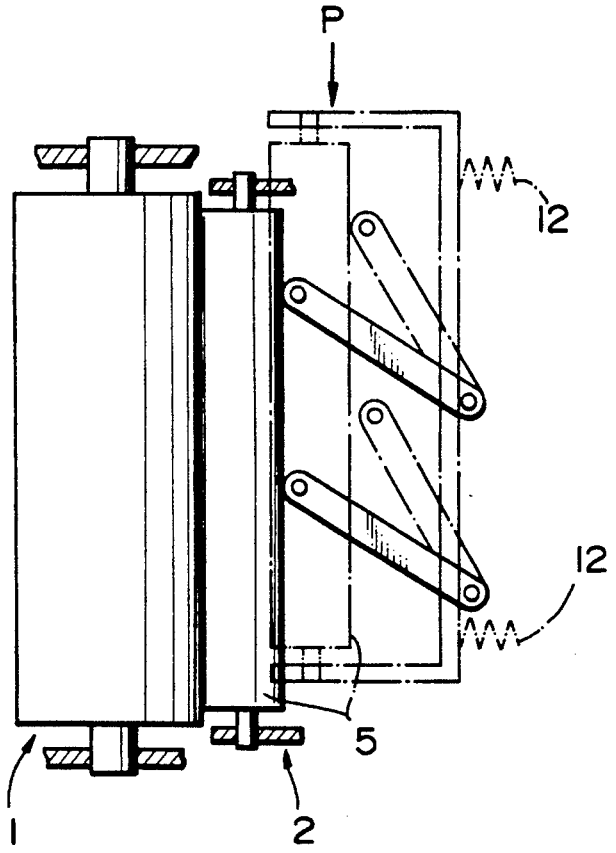
FIG. 16 is partially sectional plan view of a developing unit included in the embodiment of FIG. 14 together with a photoconductive element.

Referring to FIGS. 14 to 16, another alternative embodiment of the present invention is shown and includes a unit support member 215 on which the developing unit 2 is removably but statically mounted. This embodiment, like the previous embodiments, is successful in directing the reaction forces exerted in the vertical direction by the unit support member 215 on the developing unit 2 upward at all times, thereby achieving the various advantages as described previously. Specifically, in this particular embodiment, a link composed of a suitable number of link plates, two link plates 119 in the illustrative embodiment, is disposed below the unit support member 215. The link is rotatably connected at one end to the structural member 11 of the copier body by pins 51 and at the other end to the unit support member 251 by pins 52. In this configuration, the unit support member 215 carrying the developing unit 2 therewith is movable between a position indicated by a solid line and a position indicated by a phantom line in FIG. 14. The support member 215, therefore, is movable toward and away from the drum 1. The spring 12 constantly biases the unit support member 215 and, therefore, the developing roller 5 toward the drum 1.

This embodiment, like any of the previous embodiments, enhances efficient mounting and dismounting of the developing unit 2 while suppressing the variation in the pressure acting between the developing roller 5 and the drum 1. In this particular embodiment, the developing unit 2 may be biased by a spring or similar biasing arrangements in a direction parallel to the axis of the developing roller 5, as indicated by an arrow P in FIG. 16.

Figure 17A:
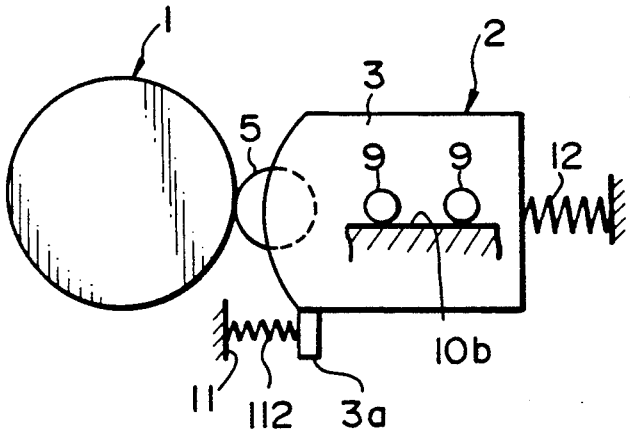
FIGS. 17A and 17B are schematic views showing a specific construction of a retracting arrangement.
Figure 17B:
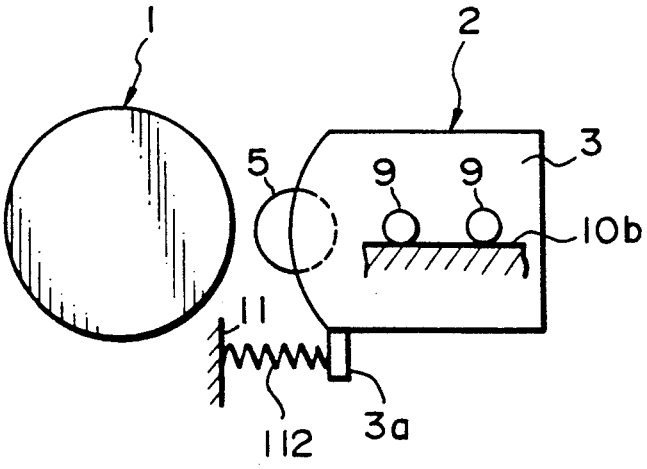

Referring to FIGS. 17A and 17B, another alternative embodiment of the present invention is shown. This embodiment is the same as the embodiment of FIG. 3 in that the guide rollers 9 mounted on the toner container 3 of the developing unit 2 are rollably supported on the guide surfaces **10*b*, and in that the developing unit 2 is constantly urged toward the drum 1 by the spring 12 to hold the roller 9 in pressing contact with the drum 1. In the embodiment of FIGS. 17A and 17B, another compression spring 112 is preloaded between the structural member 11 of the copier body and a tongue 3*a* which extends from the toner container 3. Usually, the spring 12 overcomes the spring 112 to maintain the developing roller 5 in pressing contact with the drum 1. When it is desired to shift the developing roller 5 away from the drum 1 for the purpose of removing the developing unit 2 or for maintenance purpose, for example, the pressure acting on the developing unit 2 is cancelled by removing the spring 12. Then, the developing unit 2 is urged away from the drum 1 by the other spring 112 to a retracted position shown in FIG. 17B. In this position, the developing roller 5 is prevented from hitting against the drum 1 even if the developing unit 2 is released from the operator's hand. This allows the mounting and dismounting of the developing unit 2 as well as various kinds of maintenance work to be preformed with ease without the fear of damage to the drum 1 and roller 5. When the spring 12 is loaded again to bias the developing unit 2, the developing unit 2 will be returned to the usual operative position shown in FIG. 17A**.

Figure 18A:
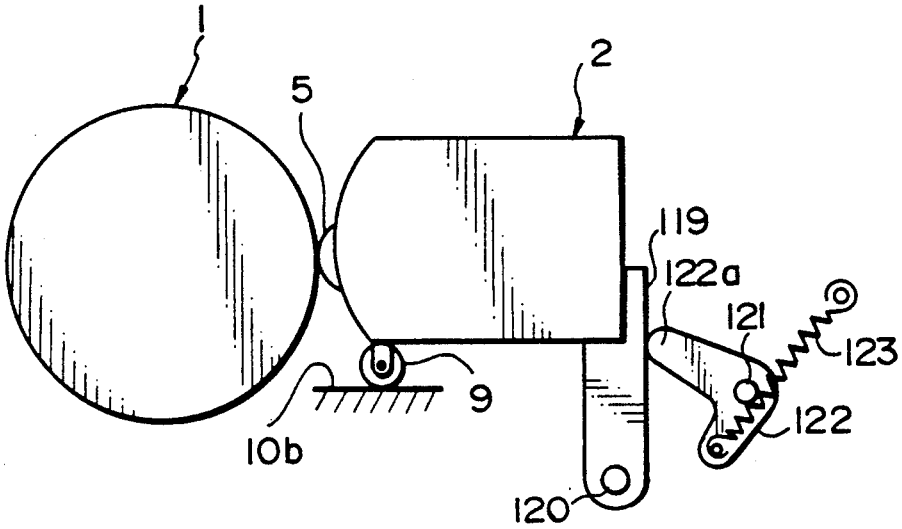
FIGS. 18A and 18B are schematic views showing another specific construction of the retracting arrangement.
Figure 18B:
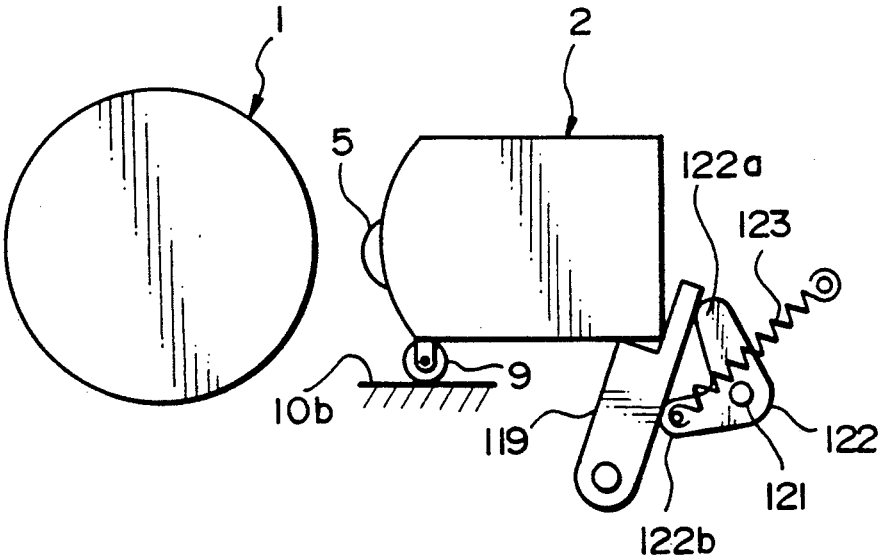

FIGS. 18A and 18B show another alternative embodiment of the present invention. As shown, the rollers are mounted on the bottom of the developing unit 2 and rollably supported on the guide surfaces **10*b*. A support link 119 is rotatably connected at one end thereof to the structural member of the copier body by a pin 120. The rear end of the unit 2 is seated on the support link 119. A pressing link 122 is also rotatably connected to the structural member by a p in 121 and is constantly biased counterclockwise as viewed in FIG. 18A by a tension spring 123. One arm 122*a* of the pressing link 122 is abutted against the support line 119. In this condition, the developing roller 5 mounted on the developing unit 2 is held in pressing contact with the drum 1 for performing a usual developing operation. When the pressing link 122 is rotated clockwise as viewed in FIG. 18A, the spring 123 is shifted over the pine 121 which is the fulcrum of the pressing link 122, as shown in FIG. 18B. As a result, the pressing line 122 tends to rotate clockwise as viewed in FIG. 18B by the spring 123, whereby the arms 122*a* and 122*b* of the link 122 abut against the developing unit 2 to maintain the latter in the position shown in FIG. 18B. Consequently, the developing roller 5 of the developing unit 2 is spaced apart from the drum 1 to facilitate the mounting and dismounting of the unit 2 as well as maintenance, as in the embodiment of FIGS. 17A and 17B**.

Figure 19:
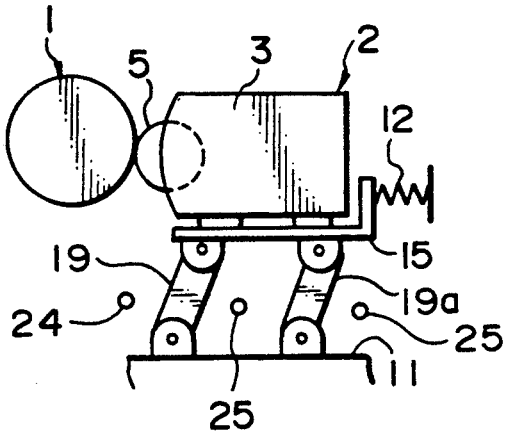
FIG. 19 is a view similar to FIG. 8, showing an alternative embodiment of the present invention.

In the embodiment of FIGS. 17A and 17B or the embodiment of FIGS. 18A and 18B, the spring 112 or the pressing link 122 and spring 123 constituted the arrangement for shifting the developing unit 2 away from the drum 1 to the retracted position. FIG. 19 shows an arrangement wherein the unit support member 15 is supported by the structural member 11 through the link plates 19 and **19*a*, as in the embodiment of FIG. 8. In any of the construction shown in FIGS. 8 and 19, the retracting arrangement may be implemented as stops 25 which are rigidly fitted on the copier body. Then, when the force of the spring 12 biasing the developing unit 2 is removed, the link plates 19 and 19*a* will abut against the stops 25 to hold the developing unit 2 in a retracted position. In this case, stops 24 may be located at the opposite side to the stops 25. When the developing unit 2 and drum 1 are removed from the copier body, the link plates 19 and 19*a* will abut against the stops 24 to prevent the unit support member 15** and link plates from interfering with other components and structural elements of the copier body.

The specific constructions of the retracting arrangements shown and described are applicable not only to the illustrative embodiments of the present invention wherein the developing unit 2 is not pressed from above and, therefore, can be lifted up, but also to the prior art arrangements of FIGS. 1 and 2 wherein the developing unit is pressed from above. When the retracting arrangements of FIGS. 17A and 17B is applied to the construction shown in FIG. 4, for example, it is of course necessary to calculate the external forces and moments acting on the developing unit 2 by taking account of the force of the spring 112 and thereby to direct the reaction forces $N_1$ and $N_2$ upward at all times.

In any of the illustrative embodiments stated above, at least one of the drum 1 and developing roller 5 may be provided with an elastic surface portion in order to allow the drum 1 and roller 5 to press against each other with some margin and, therefore, with a uniform pressure distribution. However, the present invention is of course practicable even when both of the drum 1 and roller 5 are made of rigid material.

Figure 20:
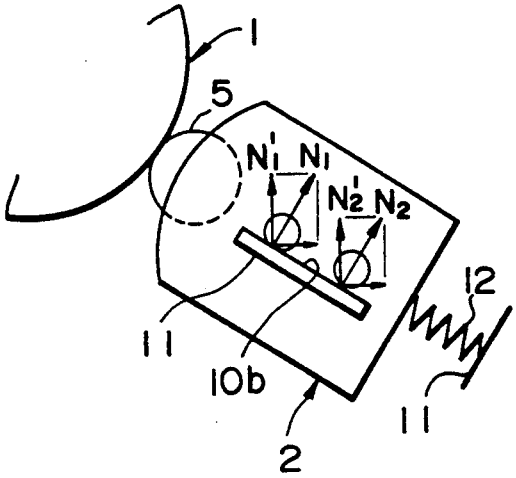
FIG. 20 is a schematic view showing an alternative embodiment of the present invention in which a developing unit is supported in an inclined position.

As shown in FIG. 20, the developing unit 2 may be supported on the guide surfaces **10*b* in an inclined position. In this case, while an arrangement is also made such that the reaction forces $N_1$ and $N_2$ acting on the developing unit 2** are directed upward, their direction is not precisely upward but obliquely upward. It will therefore be seen that directing the reactions upward includes directing them obliquely upward, i.e, the gist is that reaction components $N'_1$ and $N'_2$ directed upward exist.

Figure 21:
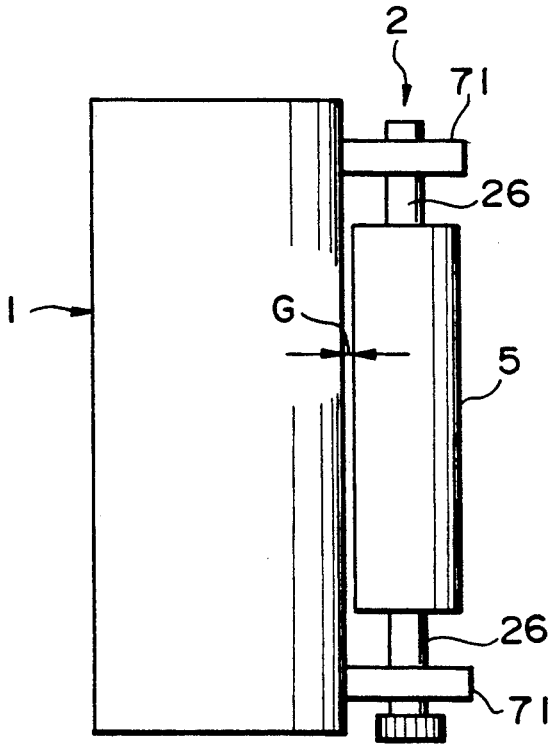
FIG. 21 is a plan view showing a developing roller and a photoconductive drum which are spaced apart from each other by a predetermined gap.

The present invention is practicable not only with a developing roller or similar rotary body which is held in direct contact with a photoconductive drum or similar image carrier, but also with a rotary body which is pressed against the image carrier through other members. For example, the present invention is applicable to an arrangement shown in FIG. 21 in which spacer rollers 71 are individually rigidly mounted on the shafts 26 of the developing roller 5 and pressed against the drum 1, while the developing roller 5 is spaced apart from the drum 1 by a predetermined gap G. The arrangement of FIG. 21 causes the developing unit 2 to perform so-called non-contact development which is practicable with either one of a single-component developer and a two-component developer, i.e., a mixture of toner and carrier.

While the foregoing description has concentrated on an image carrier in the form of the drum 1 and a processing unit in the form of a developing unit 2, the present invention is applicable to any other kind of processing unit. For example, the developing unit may be of the kind having a charging roller for charging a drum, a transferring roller for transferring a toner image from the drum to a paper sheet, a fur brush or cleaning roller for removing toner particles form the drum, or similar rotary body, and a support member for supporting the rotary body.

In summary, it will be seen that the present invention provides an image forming apparatus having a processing unit which achieves various unprecedented advantages as enumerated below.

(1) The processing unit of the apparatus is supported in a stable manner on the apparatus body and, yet, it can be lifted up in the event of removal.

(2) The processing unit is readily mounted and dismounted from a unit support member. When the processing unit is replaced with another, a change in the pressure exerted by a rotary member of the unit on an image carrier is eliminated.

(3) A developing unit can be maintained in a retracted position where it is spaced apart from the image carrier, facilitating the replacement of the developing unit, maintenance, etc.

Various modifications will become possible for those skilled in the art after receiving the teachings of the present disclosure without departing from the scope thereof.

What is claimed is:

1. An image forming apparatus comprising:

a body;

an image carrier rotatably supported by said body for forming an electrostatic latent image on a surface of said image carrier;

a processing unit having a center of gravity and a rotary body having a driving torque, the rotary body being pressed against the surface of said image carrier resulting in a frictional force, and said processing unit being supported by said body for movement toward and away from said image carrier; and biasing means for biasing said processing unit with a force exerted in a direction for pressing said rotary body of said processing unit against said image carrier, said force of said biasing means being applied to said processing unit;

wherein a resultant force of at least the driving torque of said rotary body, said frictional force of said image carrier and said rotary body and a moment of the force of the biasing means relative to said center of gravity of said processing unit is always directed downward during operation of said image forming apparatus such that reaction forces exerted in a vertical direction by said body on said processing unit are directed upward at all times.

2. An apparatus as claimed in claim 1, further comprising a unit support member movable toward and away form said image carrier together with said processing unit, said processing unit being supported by said body through said unit support member, reaction forces exerted in the vertical direction by said unit support member on said processing unit being directed upward at all times.

3. An apparatus as claimed in claim 2, further comprising links individually rotatably connected to said unit support member and said body, said unit support member being supported by said body through said links, said links, said unit support member and said body constituting a four-articulation rotary linkage.

4. An apparatus as claimed in claim 1, further comprising retracting means for holding said processing unit in a position spaced apart from said image carrier when the condition wherein said rotary body of said processing unit is pressed against said image carrier is cancelled.

5. An apparatus as claimed in claim 1, wherein said image carrier, said processing unit and said rotary body comprise a photoconductive drum, a developing unit, and a developing roller, respectively.

6. An apparatus as claimed in claim 1, wherein said biasing means comprises a compressing spring.

7. An image forming apparatus comprising:

a body;

an image carrier rotatably supported by said body for forming an electrostatic latent image on a surface of said image carrier;

a processing unit having a rotary body pressing against the surface of said image carrier, said processing unit being supported by said body movably toward and away from said image carrier;

biasing means for biasing said processing unit in a direction for pressing said rotary body of said processing unit against said image carrier; and retracting means for retracting said processing unit to a position spaced apart from said image carrier when the condition wherein said rotary body of said processing unit is pressed against said image carrier is cancelled;

wherein said processing unit is arranged such that reaction forces exerted in a vertical direction by said body on said processing unit are directed toward at all times.

8. An apparatus as claimed in claim 7, wherein said image carrier, said processing unit and said rotary body comprise a photoconductive drum, a developing unit, and a developing roller, respectively.

9. An apparatus as claimed in claim 7, wherein said second biasing means comprises a compression spring.

* * * * *